US008915005B2

(12) United States Patent
Grimshaw et al.

(10) Patent No.: US 8,915,005 B2
(45) Date of Patent: Dec. 23, 2014

(54) FOLDABLE STOCK ASSEMBLY

(71) Applicant: Sig Sauer, Inc., Newington, NH (US)

(72) Inventors: David A. Grimshaw, Epping, NH (US); David Samuel Thompson, Elizabeth South (AU); Anthony John Campman, Elizabeth South (AU)

(73) Assignee: Sig Sauer, Inc., Exeter, NH (US)

( * ) Notice: Subject to any disclaimer, the term of this patent is extended or adjusted under 35 U.S.C. 154(b) by 43 days.

(21) Appl. No.: 13/742,830

(22) Filed: Jan. 16, 2013

(65) Prior Publication Data

US 2014/0196346 A1 Jul. 17, 2014

(51) Int. Cl.
*F41C 23/04* (2006.01)

(52) U.S. Cl.
CPC ..... *F41C 23/04* (2013.01)
USPC ..... 42/73

(58) Field of Classification Search
CPC ..... F41C 23/14; F41C 23/04; F41C 23/12
USPC ..... 42/73, 75.03, 71.01, 72, 75.01
See application file for complete search history.

(56) References Cited

U.S. PATENT DOCUMENTS

| | | | | |
|---|---|---|---|---|
| 8,656,623 | B1 * | 2/2014 | Chvala | 42/75.03 |
| 2005/0115140 | A1 * | 6/2005 | Little | 42/118 |
| 2009/0288324 | A1 * | 11/2009 | Peterson et al. | 42/75.03 |
| 2010/0212206 | A1 * | 8/2010 | Griffin | 42/73 |
| 2011/0131857 | A1 * | 6/2011 | Kuczynko et al. | 42/73 |
| 2012/0030983 | A1 * | 2/2012 | Kuczynko et al. | 42/73 |
| 2012/0137561 | A1 * | 6/2012 | Ludlow | 42/75.03 |
| 2012/0137562 | A1 * | 6/2012 | Langevin et al. | 42/75.03 |
| 2012/0180354 | A1 * | 7/2012 | Sullivan et al. | 42/16 |
| 2013/0212920 | A1 * | 8/2013 | Law | 42/75.03 |

* cited by examiner

*Primary Examiner* — Daniel J Troy
*Assistant Examiner* — John D Cooper
(74) *Attorney, Agent, or Firm* — Finch & Maloney PLLC

(57) ABSTRACT

A folding stock assembly for a firearm includes a butt stock portion; a receiver interface portion; and a bidirectional hinge assembly configured to allow the butt stock portion to bidirectionally pivot with respect to the receiver interface portion.

23 Claims, 5 Drawing Sheets

(cross-section along section line AA)

FOLDABLE STOCK ASSEMBLY

TECHNICAL FIELD

This disclosure relates to stock assemblies and, more particularly, to foldable stock assemblies for use on firearms.

BACKGROUND

Firearms are tool designed for a unique purpose. And just like with other type of tool, the convenience/usability/accuracy of a firearm is highly important. Accordingly, firearms often employ enhanced features that are designed to bolster their convenience/usability/accuracy. Accordingly, firearms often employ optics (e.g., halo sights, traditional scopes) to enhance their accuracy. Further, pistol grips may be utilized for enhance control and accessory rails may enhance usefulness. Additionally, firearms may include a foldable stock assembly to allow for compact storage and use as a pistol.

SUMMARY OF DISCLOSURE

In one implementation, a folding stock assembly for a firearm includes a butt stock portion; a receiver interface portion; and a bidirectional hinge assembly configured to allow the butt stock portion to bidirectionally pivot with respect to the receiver interface portion.

One or more of the following features may be included. The butt stock portion may be configured to allow for a length of pull adjustment. The butt stock portion may be configured to allow for a cheek weld adjustment. The bidirectional hinge assembly may include a first hinge assembly; a first latch assembly configured to releasably lock the first hinge assembly in a non-folded position; a second hinge assembly; and a second latch assembly configured to releasably lock the second hinge assembly in the non-folded position.

The bidirectional hinge assembly may further include a coupler assembly configured to pivotally couple the first hinge assembly and the second hinge assembly. A first catch assembly may be configured to releasably hold the butt stock portion in a first folded position. A second catch assembly may be configured to releasably hold the butt stock portion in a second folded position. The butt stock portion may be a synthetic butt stock portion.

In another implementation, a folding stock assembly for a firearm includes: a synthetic butt stock portion; a receiver interface portion; and a bidirectional hinge assembly configured to allow the butt stock portion to bidirectionally pivot with respect to the receiver interface portion. The bidirectional hinge assembly includes: a first hinge assembly, and a second hinge assembly.

One or more of the following features may be included. The bidirectional hinge assembly may further include: a first latch assembly configured to releasably lock the first hinge assembly in a non-folded position; and a second latch assembly configured to releasably lock the second hinge assembly in the non-folded position. The bidirectional hinge assembly may further include a coupler assembly configured to pivotally couple the first hinge assembly and the second hinge assembly. The butt stock portion may be configured to allow for a length of pull adjustment. The butt stock portion may be configured to allow for a cheek weld adjustment. A first catch assembly may be configured to releasably hold the butt stock portion in a first folded position. A second catch assembly may be configured to releasably hold the butt stock portion in a second folded position.

In another implementation, a firearm includes a barrel assembly; a receiver assembly; and a folding stock assembly. The folding stock assembly includes a butt stock portion, a receiver interface portion configured to engage the receiver assembly, and a bidirectional hinge assembly configured to allow the butt stock portion to bidirectionally pivot with respect to the receiver interface portion.

One or more of the following features may be included. The butt stock portion may be configured to allow for a length of pull adjustment. The butt stock portion may be configured to allow for a cheek weld adjustment. The bidirectional hinge assembly may include: a first hinge assembly; a first latch assembly configured to releasably lock the first hinge assembly in a non-folded position; a second hinge assembly; and a second latch assembly configured to releasably lock the second hinge assembly in the non-folded position.

The bidirectional hinge assembly may further include: a coupler assembly configured to pivotally couple the first hinge assembly and the second hinge assembly. A first catch assembly may be configured to releasably hold the butt stock portion in a first folded position; and a second catch assembly may be configured to releasably hold the butt stock portion in a second folded position. The butt stock portion may be a synthetic butt stock portion.

The receiver assembly may be a bolt action receiver assembly. The receiver assembly may be a pump action receiver assembly. The receiver assembly may be a semi-automatic/fully automatic receiver assembly.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Figure 1A:
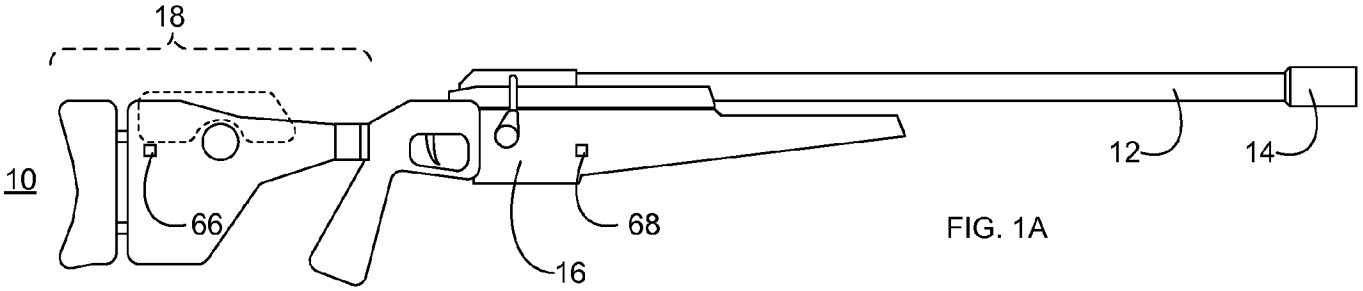
FIGS. 1A & 1B are right-side views of a firearm including a folding stock assembly.

Referring to FIGS. 1A, 1B, 2A, 2B & 3, there is shown firearm 10. Firearm 10 may include barrel assembly 12, to which muzzle brake 14 may be attached. Barrel assembly 12 may be coupled to receiver assembly 16. While this particular example, receiver assembly 16 is shown to be a bolt action receiver assembly (e.g., a traditional bolt action or a straight-pull bolt action), other configurations are possible and are considered to be within the scope of this disclosure and the related claims. For example, receiver assembly 16 may be a pump action receiver assembly (such as used in a shotgun, not shown) or a semi-automatic/fully automatic receiver assembly (such as used in an assault weapon/battle rifle, not shown). Firearm 10 may include folding stock assembly 18, which may include butt stock portion 20, receiver interface portion 22, and bidirectional hinge assembly 24.

Butt stock portion 20 of folding stock assembly 18 may be configured to allow for a length of pull adjustment. For example, butt stock portion 20 may include shoulder interface 26 which may be longitudinally displaceable (in the direction of arrow 28) via e.g. one or more rods assemblies 30, 32 that may be slidably attached to main body 34 of butt stock portion 20. For example, through the use of shoulder interface 26, the distance between the shoulder of the user (not shown) of firearm 10 and trigger assembly 36 of firearm 10 may be adjusted, thus allowing for more comfortable and/or efficient use of firearm 10.

Further, butt stock portion 20 of folding stock assembly 18 may be configured to allow for a cheek weld adjustment. For example, butt stock portion 20 may include cheek interface 38 (shown in phantom), which may be latitudinally displaceable (in the direction of arrow 40), thus allowing the user (not shown) of firearm 10 to latitudinally position their eye behind a sighting device (such a holographic site, a scope, or iron sights, not shown).

Depending upon the manner in which butt stock portion 20 is constructed, butt stock portion 20 may be constructed of an organic material (e.g. wood) or may be constructed of a synthetic material (e.g. fiberglass-reinforced plastic)

As discussed above, firearm 10 may include receiver assembly 16 which may be coupled to barrel assembly 12. Accordingly, receiver interface portion 22 may be configured to couple receiver assembly 16 to folding stock assembly 18. For example, receiver interface portion 22 may be configured to be rigidly affixed to receiver assembly 16 via e.g. one or more threaded fasteners (not shown).

Figure 1B:
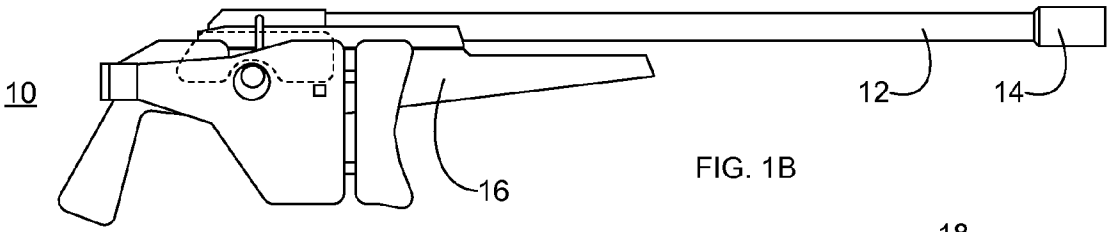
Figure 2A:
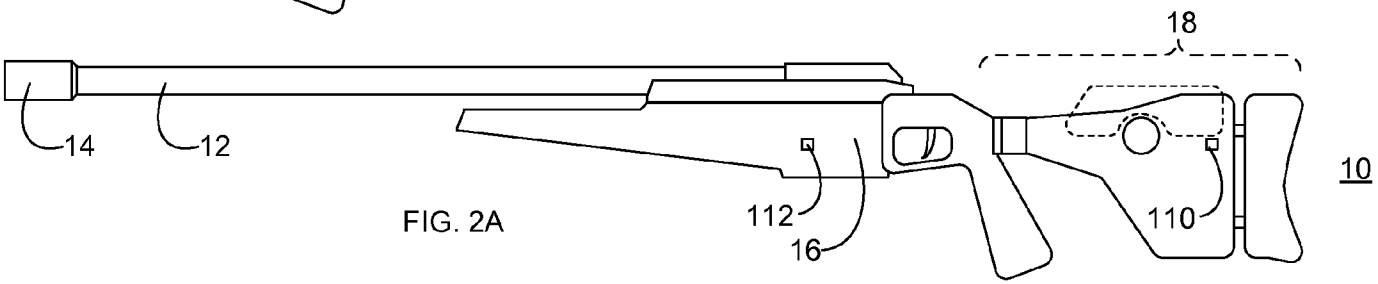
FIGS. 2A & 2B are left-side views of a firearm including the folding stock assembly of FIG. 1.
Figure 2B:
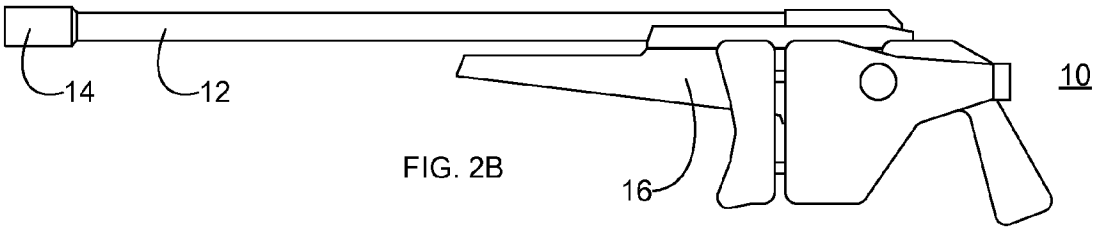
Figure 3:
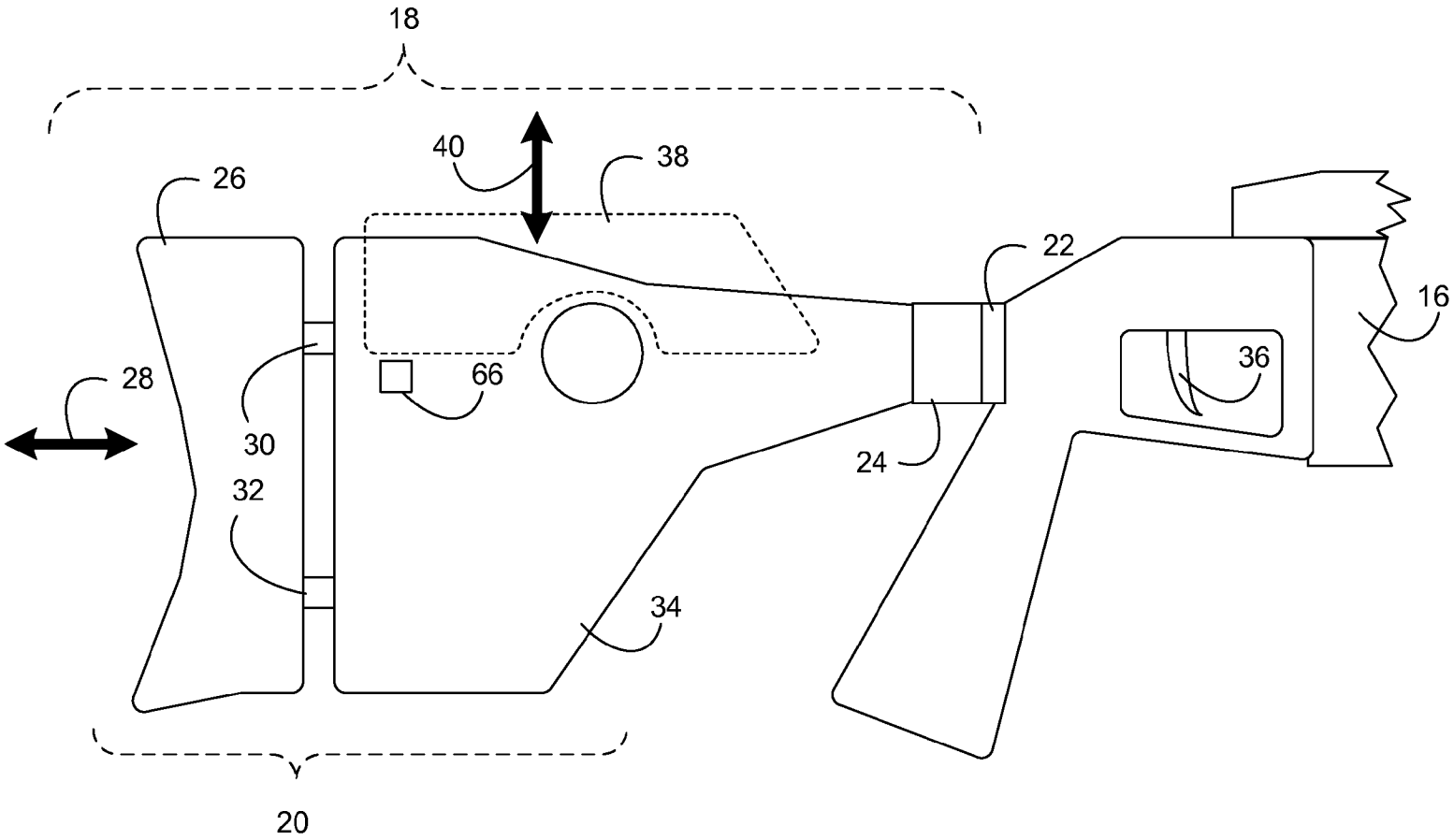
FIG. 3 is a detail view of the folding stock assembly of FIG. 1.

Bidirectional hinge assembly 24 may be configured to allow butt stock portion 20 to bidirectionally pivot with respect to receiver interface portion 22. Specifically, FIG. 1A illustrates a right-side view of firearm 10 with butt stock portion 20 positioned in a non-folded position, wherein FIG. 1B illustrates the same right-side view of firearm 10 with butt stock portion 20 positioned in a first folded position (e.g. butt stock portion 20 positioned on the right side of firearm 10). Further, FIG. 2A illustrates a left-side view of firearm 10 with butt stock portion 20 positioned in a non-folded position, wherein FIG. 2B illustrates the same left-side view of firearm 10 with butt stock portion 20 positioned in a second folded position (e.g. butt stock portion 20 positioned on the left side of firearm 10).

Figure 4A:
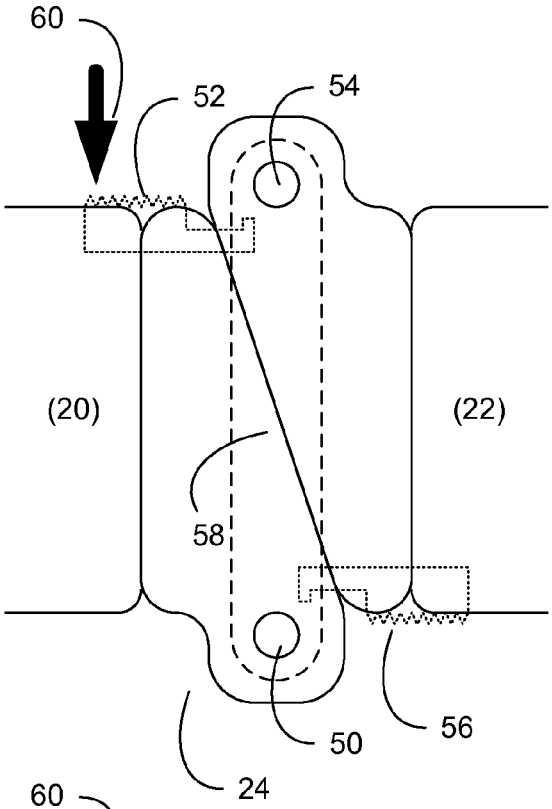
FIGS. 4A, 4B & 4C are top views of the bidirectional hinge assembly of the folding stock assembly of FIG. 1.
Figure 4B:
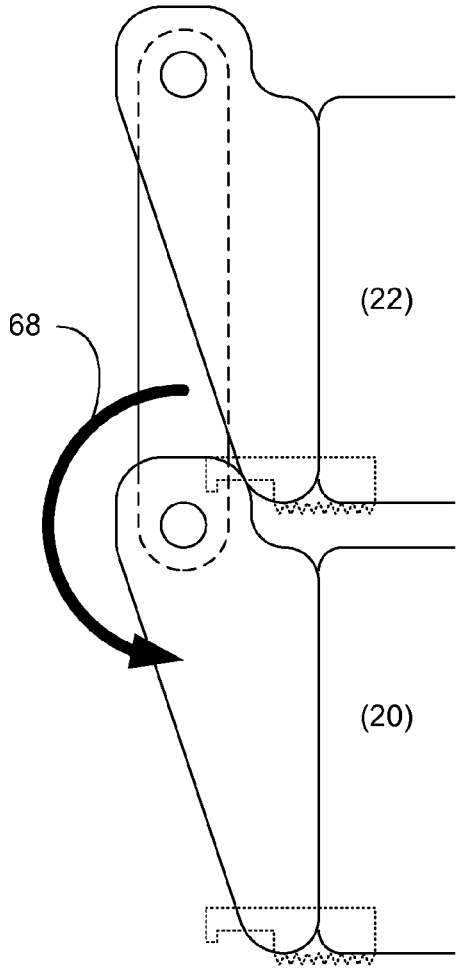
Figure 4C:
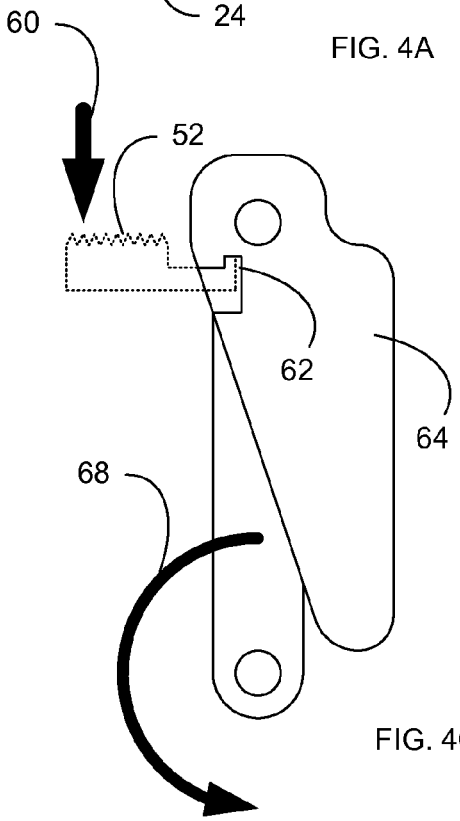

Referring also to FIGS. 4A, 4B, 4C, bidirectional hinge assembly 24 may include first hinge assembly 50 and first latch assembly 52 configured to releasably lock first hinge assembly 50 in a non-folded position. Bidirectional hinge assembly 24 may further include second hinge assembly 54 and second latch assembly 56 configured to releasably lock second hinge assembly 54 in the non-folded position. Bidirectional hinge assembly 24 may also include coupler assembly 58 configured to pivotally couple first hinge assembly 50 and second hinge assembly 54.

FIGS. 4A, 4B, 4C illustrate a top view of the operation of bidirectional hinge assembly 24 when folding butt stock portion 20 of folding stock assembly 18 into the first folded position (e.g. butt stock portion 20 positioned on the right side of firearm 10). In order to effectuate the folding of butt stock portion 20 into this first folded position, the user of firearm 10 may depress first latch assembly 52 (in the direction of arrow 60), resulting in first latch assembly 52 disengaging from first recess 62. Depending upon the manner in which bidirectional hinge assembly 24 is configured, first recess 62 may be included within coupler assembly 58 or first bracket 64 of bidirectional hinge assembly 24. Once the user of firearm 10 depresses first latch assembly 52 (in the direction of arrow 60), the user of firearm 10 may rotate (in the direction of arrow 68) butt stock portion 20 of folding stock assembly 18 into the first folded position (e.g. butt stock portion 20 positioned on the right side of firearm 10).

Referring again to FIG. 1A, folding stock assembly 18 may include first catch assembly 66, which may be configured to releasably hold butt stock portion 20 in the first folded position (e.g. butt stock portion 20 positioned on the right side of firearm 10). First catch assembly 66 may be configured to releasably engage first mating catch 68 positioned on the right-side of firearm 10.

Figures 5A, 5B, 5C:
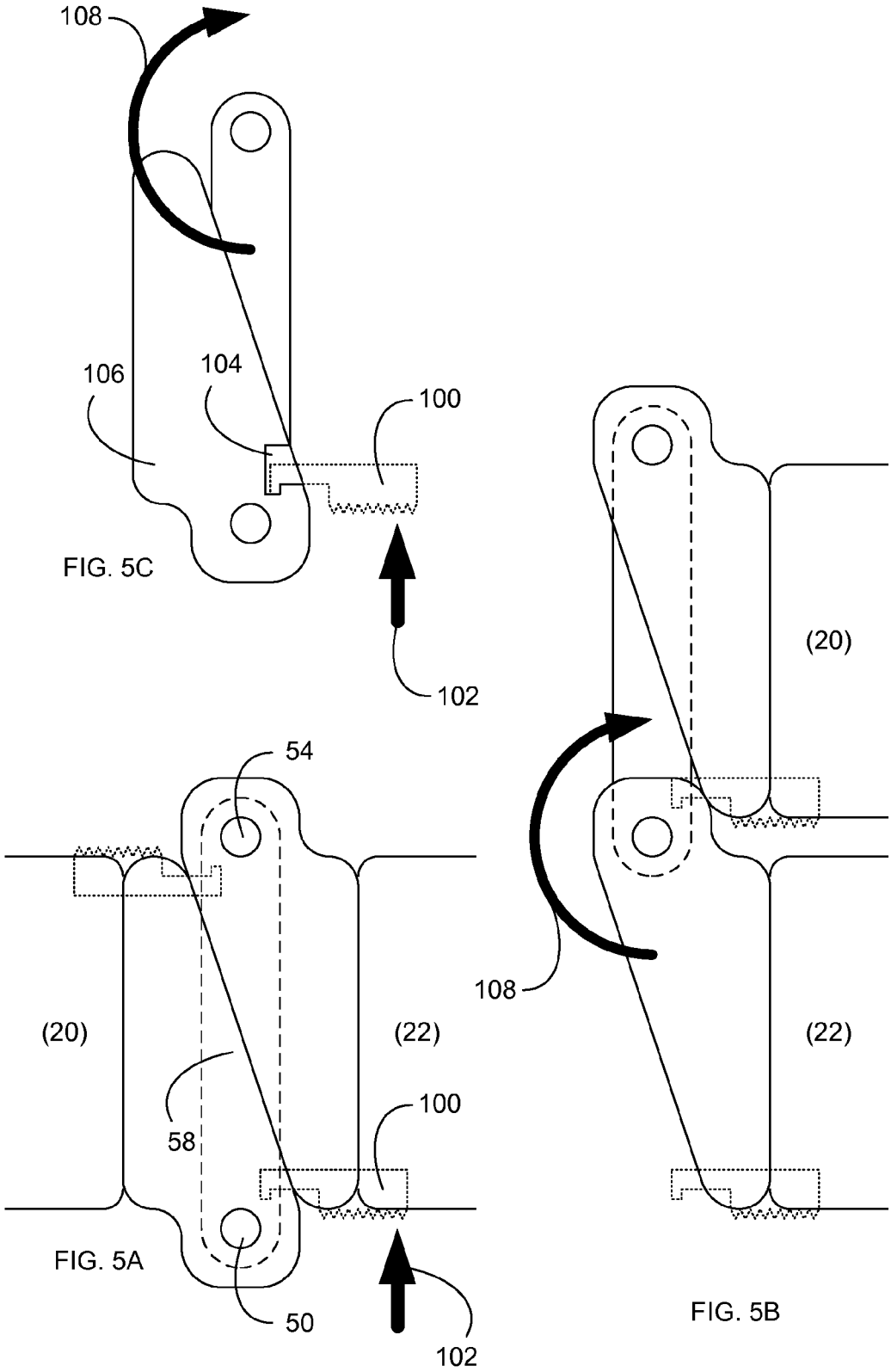
FIGS. 5A, 5B & 5C are top views of the bidirectional hinge assembly of the folding stock assembly of FIG. 1.

Referring also to FIGS. 5A, 5B, 5C, a top view of bidirectional hinge assembly 24 is shown to illustrate the operation of folding butt stock portion 20 of folding stock assembly 18 into the second folded position (e.g. butt stock portion 20 positioned on the left side of firearm 10). In order to effectuate the folding of butt stock portion 20 into this second folded position, the user of firearm 10 may depress second latch assembly 100 (in the direction of arrow 102), resulting in second latch assembly 100 disengaging from second recess 104. Depending upon the manner in which bidirectional hinge assembly 24 is configured, second recess 104 may be included within coupler assembly 58 or second bracket 106 of bidirectional hinge assembly 24. Once the user of firearm 10 depresses second latch assembly 100 (in the direction of arrow 102), the user of firearm 10 may rotate (in the direction of arrow 108) butt stock portion 20 of folding stock assembly 18 into the second folded position (e.g. butt stock portion 20 positioned on the left side of firearm 10).

Referring again to FIG. 2A, folding stock assembly 18 may include second catch assembly 110, which may be configured to releasably hold butt stock portion 20 in the second folded position (e.g. butt stock portion 20 positioned on the left side of firearm 10). Second catch assembly 110 may be configured to releasably engage second mating catch 112 positioned on the left-side of firearm 10.

Figure 6A:
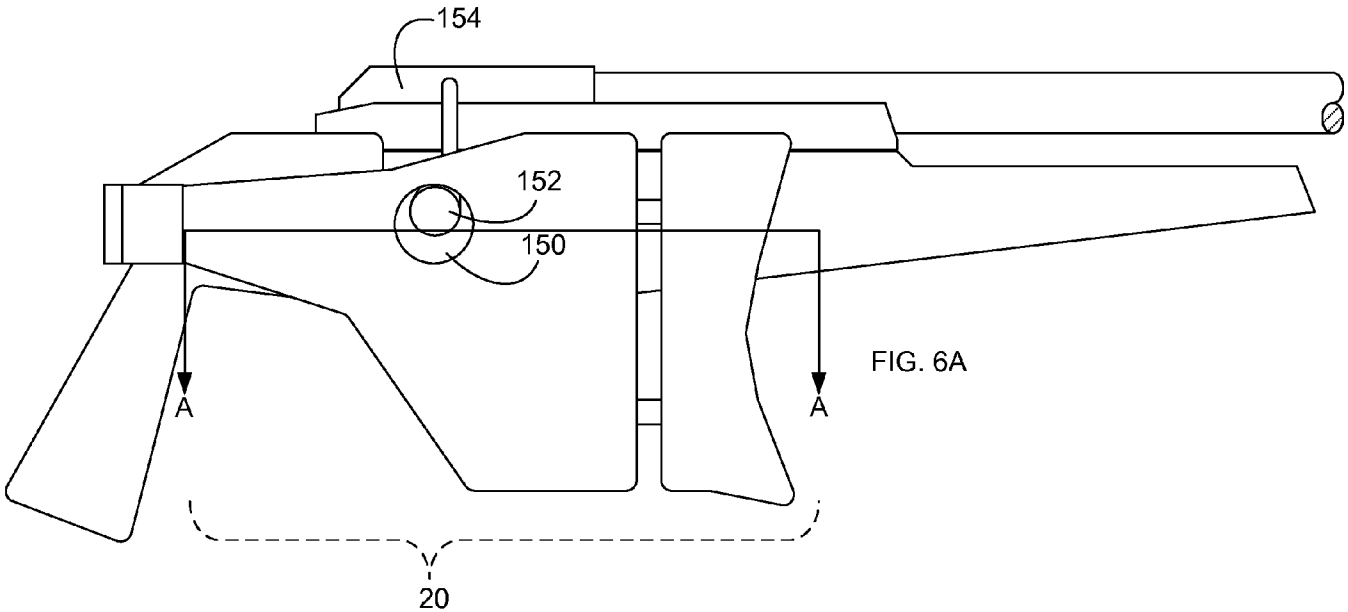
FIGS. 6A & 6B are detail views of a bolt retention receptacle included within the folding stock assembly of FIG. 1.
Figure 6B:
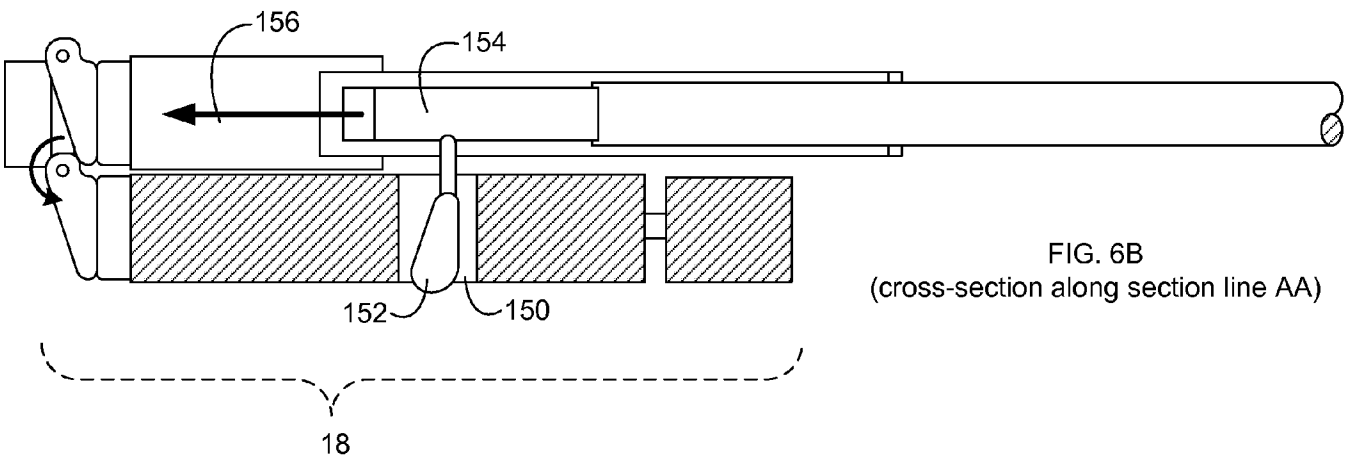

Referring also to FIGS. 6A & 6B, butt stock portion 20 of folding stock assembly 18 may include bolt retention receptacle 150 configured to releasably receive bolt handle 152 of bolt assembly 154 when butt stock portion 20 is positioned in the first folded position (e.g. butt stock portion 20 positioned on the left side of firearm 10). Bolt retention receptacle 150 may be configured to impede rearward motion (in the direction of arrow 156) of bolt assembly 154 when bolt handle 152 is positioned within bolt retention receptacle 150. For example, bolt retention receptacle 150 may be configured to fit snuggly or fit loosely around bolt handle 152 whenever (and as discussed above) butt stock portion 20 is held in the first folded position (e.g. butt stock portion 20 positioned on the right side of firearm 10) via first catch assembly 66 in conjunction with first mating catch 68. Accordingly and through the use of bolt retention receptacle 150, the inadvertent detachment of bolt assembly 154 from firearm 10 may be avoided.

While bolt retention receptacle 150 is described above as capturing bolt handle 152 whenever butt stock portion 20 is positioned on the right side of firearm 10, this is for illustrative purposes only and is not intended to be a limitation of this disclosure. For example, if firearm 10 is configured such that bolt handle 152 is positioned on the left side of firearm 10, bolt retention receptacle 150 may be configured to capture bolt handle 152 whenever butt stock portion 20 is positioned on the left side of firearm 10.

Having thus described the disclosure of the present application in detail and by reference to embodiments thereof, it will be apparent that modifications and variations are possible without departing from the scope of the disclosure defined in the appended claims.

What is claimed is:

1. A folding stock assembly for a firearm comprising:

a butt stock portion;

a receiver interface portion; and a bidirectional hinge assembly including a coupler assembly, a first hinge assembly pivotally coupled to the coupler assembly, and a second hinge assembly pivotally coupled to the coupler assembly, the bidirectional hinge assembly configured to allow the butt stock portion to bidirectionally pivot with respect to the receiver interface portion from a first folded position on a first side of the firearm to a second folded position on a second side of the firearm without disconnecting either the first hinge assembly or the second hinge assembly from the coupler assembly.

2. The folding stock assembly of claim 1 wherein the butt stock portion is configured to allow for a length of pull adjustment.

3. The folding stock assembly of claim 1 wherein the butt stock portion is configured to allow for a cheek weld adjustment.

4. The folding stock assembly of claim 1 wherein the bidirectional hinge assembly includes:

a first latch assembly configured to releasably lock the first hinge assembly in a non-folded position;

and a second latch assembly configured to releasably lock the second hinge assembly in the non-folded position.

5. The folding stock assembly of claim 4 wherein the coupler assembly is configured to pivotally couple the first hinge assembly and the second hinge assembly.

6. The folding stock assembly of claim 1 further comprising:

a first catch assembly configured to releasably hold the butt stock portion in the first folded position; and a second catch assembly configured to releasably hold the butt stock portion in the second folded position.

7. The folding stock assembly of claim 1 wherein the butt stock portion is a synthetic butt stock portion.

8. A folding stock assembly for a firearm comprising:

a synthetic butt stock portion;

a receiver interface portion; and a bidirectional hinge assembly configured to allow the butt stock portion to bidirectionally pivot with respect to the receiver interface portion, wherein the bidirectional hinge assembly includes:

a coupler assembly;

a first hinge assembly pivotally coupled to the coupler assembly, the first hinge assembly configured to allow the bidirectional hinge assembly to pivot, about a first pivot point, between an extended position and a first folded position on a first side of the firearm, and a second hinge assembly pivotally coupled to the coupler assembly, the second hinge assembly configured to allow the bidirectional hinge assembly to pivot, about a second pivot point offset from the first pivot point, between the extended position and a second folded position on a second side of the firearm, and wherein the butt stock portion bidirectionally pivots with respect to the receiver interface portion from the first folded position to the second folded position without disconnecting either the first hinge assembly or the second hinge assembly from the coupler assembly.

9. The folding stock assembly of claim 8 wherein the bidirectional hinge assembly further includes:

a first latch assembly configured to releasably lock the first hinge assembly in a non-folded position; and a second latch assembly configured to releasably lock the second hinge assembly in the non-folded position.

10. The folding stock assembly of claim 9 wherein the coupler assembly is configured to pivotally couple the first hinge assembly and the second hinge assembly.

11. The folding stock assembly of claim 8 wherein the butt stock portion is configured to allow for a length of pull adjustment.

12. The folding stock assembly of claim 8 wherein the butt stock portion is configured to allow for a cheek weld adjustment.

13. The folding stock assembly of claim 8 further comprising;

a first catch assembly configured to releasably hold the butt stock portion in the first folded position; and a second catch assembly configured to releasably hold the butt stock portion in the second folded position.

14. A firearm comprising:

a barrel assembly;

a receiver assembly; and a folding stock assembly including:

a butt stock portion, a receiver interface portion configured to engage the receiver assembly, and a bidirectional hinge assembly including a coupler assembly, a first hinge assembly pivotally to the coupler assembly, and a second hinge assembly pivotally coupled to the coupler assembly, the bidirectional hinge assembly configured to allow the butt stock portion to bidirectionally pivot with respect to the receiver interface portion from a first folded position on a first side of the firearm to a second folded position on a second side of the firearm without disconnecting either the first hinge assembly or the second hinge assembly from the coupler assembly.

15. The firearm of claim 14 wherein the butt stock portion is configured to allow for a length of pull adjustment.

16. The firearm of claim 14 wherein the butt stock portion is configured to allow for a cheek weld adjustment.

17. The firearm of claim 14 wherein the bidirectional hinge assembly includes:

a first latch assembly configured to releasably lock the first hinge assembly in a non-folded position;

and a second latch assembly configured to releasably lock the second hinge assembly in the non-folded position.

18. The firearm of claim 17 wherein the coupler assembly is configured to pivotally couple the first hinge assembly and the second hinge assembly.

19. The firearm of claim 14 further comprising:

a first catch assembly configured to releasably hold the butt stock portion in the first, folded position; and a second catch assembly configured to releasably hold the butt stock portion in the second folded position.

20. The firearm of claim 14 wherein the butt stock portion is a synthetic butt stock portion.

21. The firearm of claim 14 wherein the receiver assembly is a bolt action receiver assembly.

22. The firearm of claim 14 wherein the receiver assembly is a pump action receiver assembly.

23. The firearm of claim 14 wherein the receiver assembly is a semi-automatic/fully automatic receiver assembly.

* * * * *